US008436732B2

(12) United States Patent
Lamont

(10) Patent No.: US 8,436,732 B2
(45) Date of Patent: May 7, 2013

(54) FIBER BRAGG GRATING PERIMETER SECURITY SYSTEM

(76) Inventor: Jason Bentley Lamont, Ottawa (CA)

( * ) Notice: Subject to any disclaimer, the term of this patent is extended or adjusted under 35 U.S.C. 154(b) by 443 days.

(21) Appl. No.: 12/790,868

(22) Filed: May 31, 2010

(65) Prior Publication Data

US 2010/0315232 A1 Dec. 16, 2010

Related U.S. Application Data

(60) Provisional application No. 61/183,569, filed on Jun. 3, 2009.

(51) Int. Cl.
*G08B 13/00* (2006.01)

(52) U.S. Cl.
USPC ..... 340/555; 340/541; 340/557; 385/37; 385/12; 385/13

(58) Field of Classification Search ..... 340/541, 340/555, 557; 385/37, 12, 13
See application file for complete search history.

(56) References Cited

U.S. PATENT DOCUMENTS 5,319,435 A * 6/1994 Melle et al. ..... 356/32
6,298,185 B1 * 10/2001 Lai et al. ..... 385/37
7,123,785 B2 * 10/2006 Iffergan ..... 385/13
7,385,506 B2 * 6/2008 Shibata et al. ..... 340/557
7,488,929 B2 * 2/2009 Townley-Smith et al. ..... 250/227.14
2009/0269001 A1 * 10/2009 Lee ..... 385/12

FOREIGN PATENT DOCUMENTS

WO WO2007/043794 A1 4/2007

* cited by examiner

*Primary Examiner* — Hai Phan
*Assistant Examiner* — Peter Mehravar
(74) *Attorney, Agent, or Firm* — Ottawa Patent Agency Incorporated; Peter Kwa

(57) ABSTRACT

A security system lays out a sensing optical fiber tautly at the perimeter of an area to be secured. The sensing optical fiber has at least one sensing Fiber Bragg Grating (FBG) which is stretched when the sensing optical fiber is stretched by an intruder. The center wavelength of reflection of the stretched sensing FBG shifts towards longer wavelengths. The shifted center wavelength of reflection is detected using a reference FBG with a longer center wavelength of reflection. The sensing optical fiber has a loose buffer coating for isolating the sensing optical fiber and the sensing FBG from nuisance disturbances and noise such as vibrations caused by wind. Trip wires may be attached to the sensing optical fiber for enhancing intruder detection. A cut of the sensing optical fiber may be detected by monitoring the optical power exiting the far end of the sensing optical fiber.

44 Claims, 6 Drawing Sheets

FIBER BRAGG GRATING PERIMETER SECURITY SYSTEM

REFERENCE TO PRIOR APPLICATION

This application claims the benefit of U.S. Provisional Application No. 61/183,569, filed Jun. 3, 2009

FIELD OF THE INVENTION

The present invention relates to a perimeter security system for intrusion detection, using optical fibers having Fiber Bragg Gratings (FBGs).

BACKGROUND OF THE INVENTION

U.S. Pat. No. 7,385,506 granted to Shibata et al. discloses an optical-fiber-based perimeter security system. An optical fiber having Fiber Bragg Gratings (FBGs) is laid out at the perimeter of an area to be secured so that intrusion stretches the optical fiber and the FBGs in the optical fiber. FBGs reflect narrowband optical power around a center wavelength while transmitting optical power at other wavelengths. If the FBGs in the optical fiber are stretched, the center wavelength of the reflected narrowband optical power is shifted towards longer wavelengths. The magnitude of the wavelength shift is commensurate with the magnitude of the stretch. The wavelength shifts are converted into a time-varying electrical signal. The electrical signal is processed by a pattern recognition device for differentiating between true intrusion on the one hand, and false alarms due to wind and other environmental noise on the other hand. The required pattern recognition device may incur a substantial implementation effort.

SUMMARY OF THE INVENTION

The present invention avoids the disadvantage of the prior art.

According to the invention, there is provided a perimeter security system. The system comprises a sensing optical fiber for laying out tautly at the perimeter of an area to be secured. The sensing fiber includes at least one sensing Fiber Bragg Grating (FBG). The system further comprises a source of broadband optical power and means for launching the broadband optical power into the proximal end of the sensing fiber. The distal end of the sensing fiber is optically terminated. The sensing FBG reflects narrowband optical power back to the proximal end of the sensing fiber. When the sensing fiber, and hence the sensing FBG, is stretched, the center wavelength of the reflected narrowband optical power shifts towards longer wavelengths. The system yet further comprises receiving and detecting means responsive to the reflected narrowband optical power with the longer center wavelength. The system is thus responsive to an intrusion which causes a stretch of the sensing fiber.

Advantageously, the sensing fiber has a loose buffer coating for isolating the sensing fiber and the sensing FBG from nuisance disturbances and noise such as vibrations caused by wind.

BRIEF DESCRIPTION OF THE DRAWINGS

The drawings illustrate the preferred embodiments by way of example only.

DETAILED DESCRIPTION OF THE PREFERRED EMBODIMENTS

The following descriptions describe the preferred embodiments of the invention by way of example only.

Figure 1:
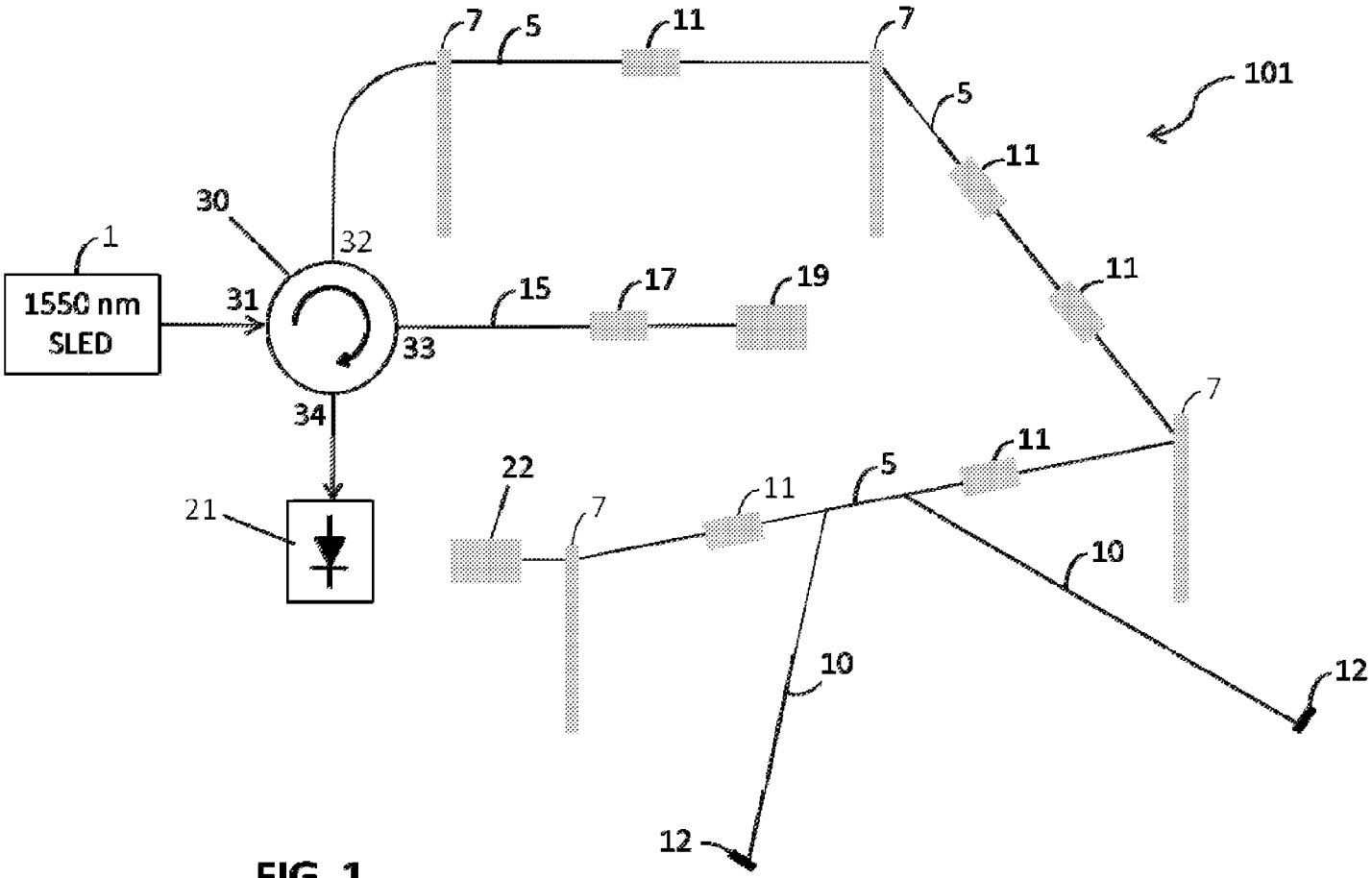
FIG. 1 shows a first preferred embodiment of a Fiber Bragg Grating (FBG) perimeter security system according to the invention for detecting intrusion causing a stretch of a sensing optical fiber having the FBG.

FIG. 1 shows a first preferred embodiment of a Fiber Bragg Grating (FBG) perimeter security system 101. The system 101 comprises a broadband optical source 1 such as a Surface-emitting Light-Emitting-Diode (SLED) or an Amplified Spontaneous Emission (ASE) device for launching optical power with wavelengths in the 1550 nm region in port 31 of a 4-port optical circulator 30. The circulator 30 launches the broadband optical power via port 32 in a proximal end of a sensing optical fiber 5. The sensing fiber 5 is laid out tautly around the perimeter of an area to be secured using fence posts 7 and securing means such as tie wraps (not shown). The sensing fiber 5 includes at least one sensing FBG 11. The sensing FBG 11 reflects narrowband optical power with a center wavelength $\lambda_S$ back to port 32 of the optical circulator 30. Optical power at other wavelengths travel through the sensing FBG 11 to the distal end of the sensing fiber 5 which is terminated with an optical terminator 22 to quench reflections from the distal end of the sensing fiber 5. The optical circulator 30 receives the narrowband optical power with the center wavelength $\lambda_S$ at port 32 and launches it via port 33 in a proximal end of a reference optical fiber 15. The reference fiber 15 includes a reference FBG 17 which reflects narrowband optical power with a center wavelength $\lambda_R$ which is about 1 nm longer than the center wavelength $\lambda_S$ of the sensing FBG 11. The reference fiber 15 has an optical termination 19 to quench reflections at the distal end of the reference fiber 15. Any reflected narrowband optical power from the reference FBG 17 with the center wavelength $\lambda_R$ is reflected back to port 33 and exits the optical circulator 30 at port 34 for detection by an optical power detector 21.

In normal use, the narrowband optical power with the center wavelength $\lambda_S$ which is reflected back from the sensing FBG 11 to port 32 exits the circulator 30 at port 33, travels in the reference fiber 15 through the reference FBG 17 to the optical termination 19. No optical power is reflected back to port 33, and hence, no optical power exits port 34 and no optical power is detected by the optical power detector 21.

However, if an intruder stretches the sensing fiber 5, and hence stretches the sensing FBG 11, the center wavelength of the narrowband optical power reflected by the sensing FBG 11 is shifted towards longer wavelengths. If the shifted center wavelength of the reflected narrowband optical power equals the center wavelength $\lambda_R$ of the reference FBG 17, the reference FBG 17 reflects the narrowband optical power back to port 33 which then exits port 34 and is detected by the optical power detector 21. Thus, detection of optical power by the optical power detector 21 indicates intrusion causing a stretch of the sensing fiber 5.

Advantageously, the sensing fiber 15 has a loose buffer coating for isolating the sensing fiber 15 and the sensing FBG 11 from nuisance disturbances and noise such as vibrations caused by wind. More advantageously, the loose buffer coating is weather-proof.

Advantageously, the reference fiber 15 including the reference FBG 17 is exposed to the same ambient temperature as the sensing fiber 5 including the sensing FBG11 for cancelling out the temperature dependencies of the center wavelengths of reflection $\lambda_R$, $\lambda_S$ of the reference FBG 17 and the sensing FBG 11, respectively.

Advantageously, the sensing fiber 5 includes multiple sensing FBGs 11 spaced apart along the length of the sensing fiber 5 to increase sensitivity to intrusion causing a stretch of the sensing fiber 5, which in turn allows for long sensing fibers 5 while maintaining sensitivity to such intrusion.

Advantageously, trip wires 10 such as common fishing lines are attached to the sensing fiber 5 and fixed to the ground with stakes 12. An intruder on foot may trip the wires 10 thereby stretching the sensing fiber 15. The trip wires 10 thus provide enhanced intruder detection.

Advantageously, an enclosure houses the broadband optical source 1, the optical circulator 30, and the optical power detector 21.

Figure 2:
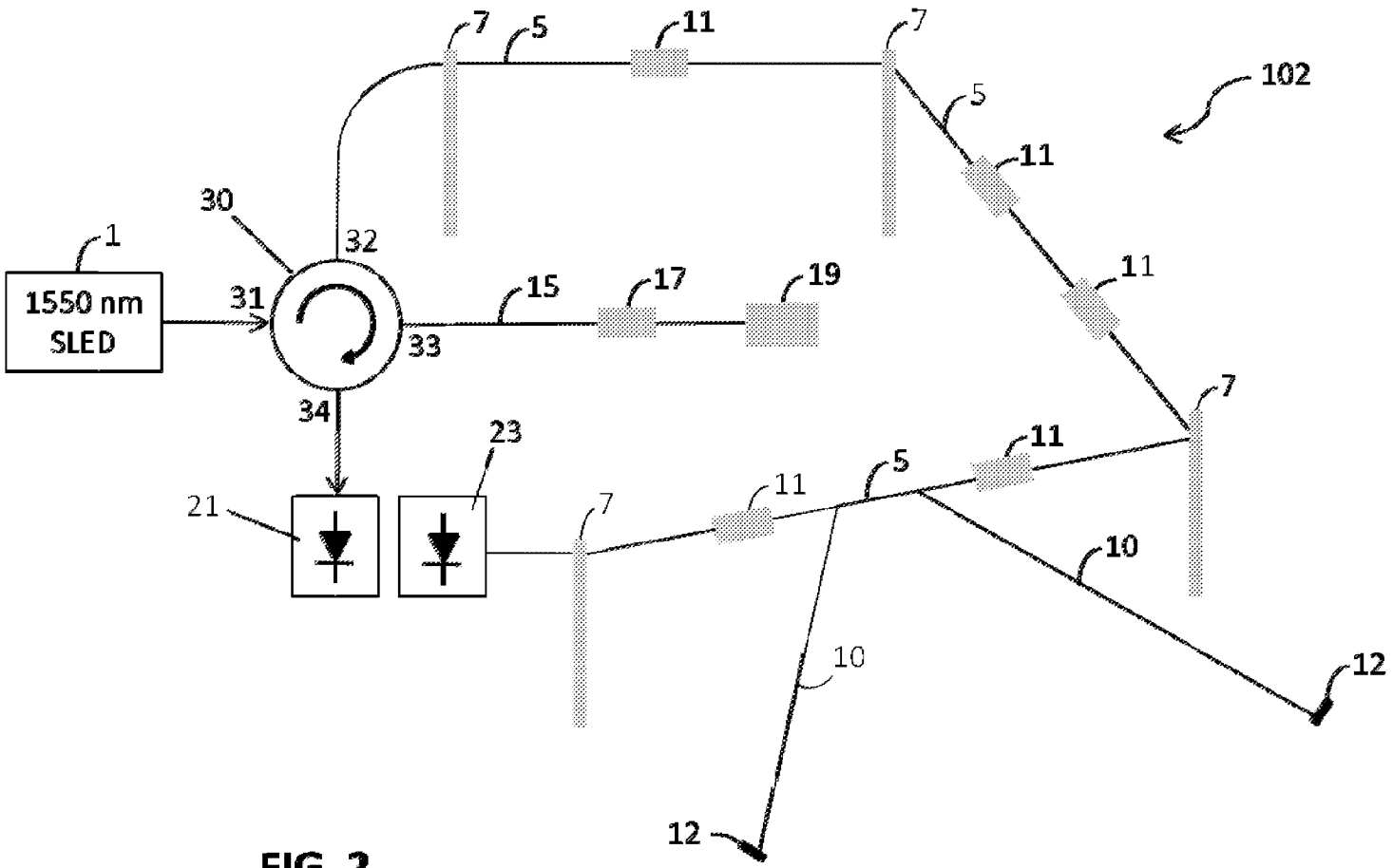
FIG. 2 shows a second preferred embodiment of the system having an optical-power-detector-based means, for detecting intrusion causing a cut of the sensing fiber.

FIG. 2 shows a second preferred embodiment of the FBG perimeter security system 102 in which an optical power detector 23 has been substituted at the distal end of the sensing fiber 5.

In normal use, broadband optical power with wavelengths that are not reflected by the sensing FBG 11 travels to and out of the distal end of the sensing fiber 5, and optical power is detected by the optical power detector 23. However, a cut of the sensing fiber 5 results in no optical power being detected by the optical power detector 23. Intrusion causing a stretch of the sensing fiber 5 is detected by optical power being detected by power detector 21, as in the first embodiment 101.

Advantageously, the sensing fiber 5 is looped back so that the optical power detector 23 can be housed in the same enclosure that houses the broadband optical source 1, the optical circulator 30, and the optical power detector 21.

Note that whereas the embodiment 101 of FIG. 1 has detection capability for intrusion causing a stretch of the sensing fiber 5, the embodiment 102 of FIG. 2 has the additional capability for intrusion detection causing a cut of the sensing fiber 5. For reference purposes in the hereinafter, the fiber cut detection capability of embodiment 102 is referred to as an optical-power-detection-based fiber cut detection capability.

Figure 3:
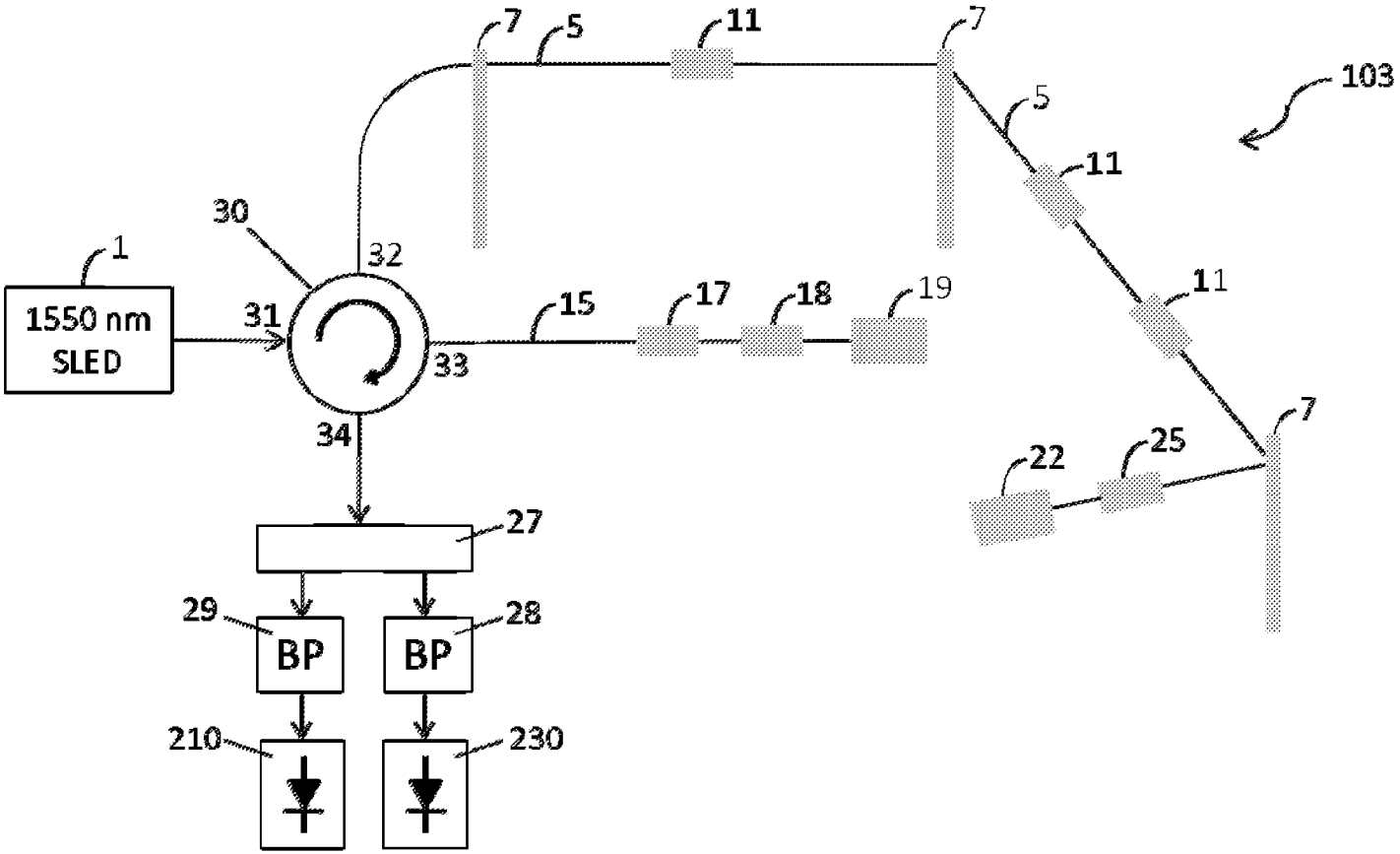
FIG. 3 shows a third preferred embodiment of the system having an FBG-based means, for detecting intrusion causing a cut of the sensing fiber.

FIG. 3 shows a third embodiment of the FBG perimeter security system 103 which has an alternative means for detecting intrusion which causes a cut of the sensing fiber 5. The alternative means comprises a fiber cut sensing FBG 25 at the distal end of the sensing fiber 5 just before the optical termination 22, and a fiber cut reference FBG 18 in the reference fiber 15. The fiber cut sensing FBG 25 and the fiber cut reference FBG 18 have the same center wavelength of reflection. Narrowband optical power is reflected by the fiber cut sensing FBG 25 back to port 32, travels to and out of port 33 into reference fiber 15, is reflected by the fiber cut reference FBG 18 back to port 33, travels to and out of port 34. The alternative means for detecting intrusion which causes a cut of the sensing fiber 5 further comprises an optical splitter 27, optical band-pass filters 28 and 29, and optical power detectors 210 and 230. The narrowband optical power reflected by the fiber cut sensing FBG 25 and the fiber cut reference FBG 18 travels through the optical splitter 27, band-pass filter 28 and is detected by the optical power detector 230. As in the first and second embodiments 101 and 102, respectively, intrusion causing a stretch of the sensing fiber 5 shifts the center wavelength of the sensing FBG 11 to the center wavelength of the reference FBG 17, narrowband optical power with a center wavelength of $\lambda_R$ exits port 34, travels through the optical splitter 27, the optical band-pass 29, and is detected by the optical power detector 210.

In normal use, optical power is thus detected by the optical power detector 230. However, an intrusion causing a cut of the sensing fiber 5 disrupts the path of the narrowband optical power reflected by the fiber cut sensing FBG 25. The optical power detected by the optical power detector 230 is greatly reduced in case of a cut of the sensing fiber 5.

Advantageously, the broadband optical source 1, the optical circulator 30, the optical splitter 27, the optical band-passes 28, 29, and the optical power detectors 210, 230 are housed in an enclosure. Note that in embodiment 103, the distal end of the sensing fiber 5 does not need to be looped back to the enclosure, as is advantageously done in embodiment 102.

Advantageously, the reference fiber 15 including the fiber cut reference FBG 18 is exposed to the same ambient temperature as the sensing fiber 5 including the fiber cut sensing FBG 25 for cancelling out the temperature dependencies of the center wavelengths of reflection of the FBGs 18 and 25.

Note that whereas the embodiment 101 of FIG. 1 has detection capability for intrusion causing a stretch of the sensing fiber 5, the embodiment 103 of FIG. 3 has the additional capability for intrusion detection causing a cut of the sensing fiber 5. For reference purposes in the hereinafter, the fiber cut detection capability of embodiment 103 is referred to as an FBG-based fiber cut detection capability.

Figure 4:
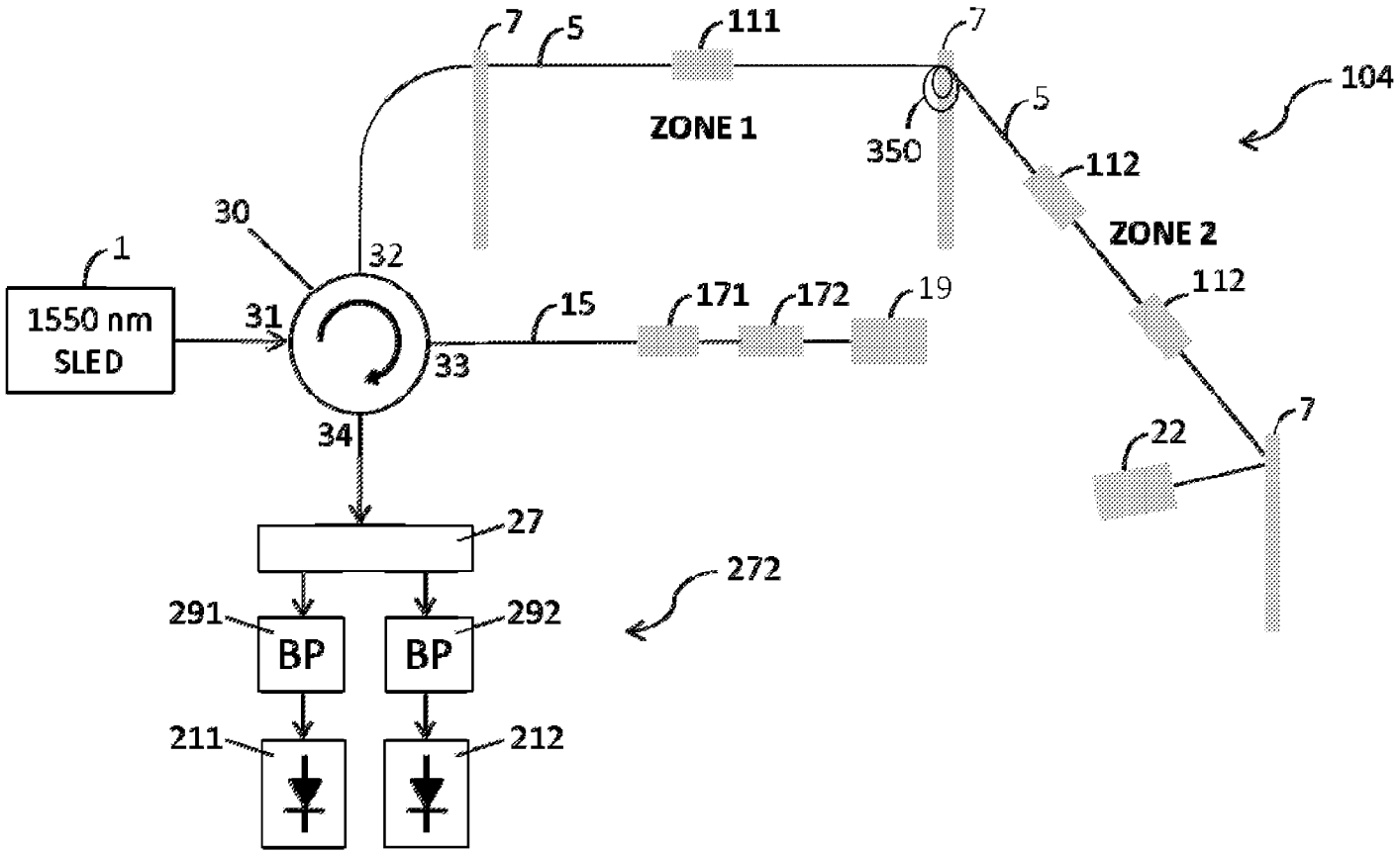
FIG. 4 shows a fourth preferred embodiment of the system having a perimeter with 2 zones.

FIG. 4 shows a fourth preferred embodiment of a Fiber Bragg Grating (FBG) perimeter security system 104 with two zones in the sensing fiber 5, ZONE 1 and ZONE 2. ZONE 1 has at least one sensing FBG 111 with a center wavelength of reflection $\lambda_{S1}$. ZONE 2 has at least one sensing FBG 112 with a center wavelength of reflection $\lambda_{S2}$. Correspondingly, the reference fiber 15 has two reference FBGs 171, 172. Reference FBG 171 has a center wavelength of reflection $\lambda_{R1}$ which is about 1 nm longer than the center wavelength of reflection $\lambda_{S1}$ of FBG 111, and reference FBG 172 has a center wavelength of reflection $\lambda_{R2}$ which is about 1 nm longer than the center wavelength of reflection $\lambda_{S2}$ of FBG 112. A proper stretch of sensing fiber 5 in ZONE 1 causes the center wavelength of reflection of FBG 111 to shift to $\lambda_{R1}$ so that narrowband optical power at wavelength $\lambda_{R1}$ exits port 34. A proper stretch of sensing fiber 5 in ZONE 2 causes the center wavelength of reflection of FBG 112 to shift to $\lambda_{R2}$ so that narrowband optical power at wavelength $\lambda_{R2}$ exits port 34. The narrowband optical powers at wavelengths $\lambda_{R1}$, $\lambda_{R2}$ exiting port 34 are separately detected with a 2-way optical-splitter-band-pass-detector-bank 272 as follows. Port 34 feeds a 2-way optical splitter 27 which splits the optical power to 2 optical band-pass and optical power detector combinations. The combination band-pass 291 and optical power detector 211 detects the narrowband optical power at $\lambda_{R1}$. The combination band-pass 292 and optical power detector 212 detects the narrowband optical power at $\lambda_{R2}$.

In normal use, the center wavelengths of reflection $\lambda_{S1}$, $\lambda_{S2}$ of the sensing FBGs 111, 112, respectively, are not shifted. There are thus no reflections from the reference FBGs 171, 172, and hence, no optical power is detected by the optical power detectors 211, 212.

However, if the sensing fiber 5 in ZONE 1 is stretched, optical power is detected by the optical power detector 211. If the sensing fiber 5 in ZONE 2 is stretched, optical power is detected by the optical power detector 212. Intrusions causing stretches of the sensing fiber 5 are thus separately detected according to zone.

Note that fiber cut detection capability can be added to the multi-zone embodiment 104 of FIG. 4 in the same ways that fiber cut detection capability has been added to the single-zone embodiment 101 of FIG. 1. An optical-power-detection-based fiber cut detection capability can be added to the embodiment 104 in the same way that the optical-power-detection-based fiber cut detection capability has been added to the embodiment 101 to arrive at the embodiment 102. An FBG-based fiber cut detection capability can be added to the embodiment 104 in the same way that the FBG-based fiber cut detection capability has been added to the embodiment 101 to arrive at the embodiment 103.

Advantageously, an optical spectrum analyzer may be used in lieu of the 2-way optical-splitter-band-pass-detector-bank 272. An optical power peak displayed at wavelength $\lambda_{R1}$ detects a stretch of the sensing fiber 5 in ZONE 1. An optical power peak displayed at wavelength $\lambda_{R2}$ detects a stretch of the sensing fiber 5 in ZONE 2.

Advantageously, the sensing fiber 5 has multiple zones ZONE 1, ZONE 2, . . . ZONE N. Each zone has at least one sensing FBG, FBG 111, FBG 112, . . . FBG 11N with center wavelengths of reflection $\lambda_{S1}$, $\lambda_{S2}$, . . . $\lambda_{SN}$, respectively. Correspondingly, the reference fiber 15 has N reference FBGs, FBG 171, FBG 172, . . . FBG 17N with center wavelengths of reflection $\lambda_{R1}$, $\lambda_{R2}$, . . . $\lambda_{RN}$, respectively. The center wavelengths of reflection of the reference FBGs $\lambda_{R1}$, $\lambda_{R2}$, . . . $\lambda_{RN}$ are about 1 nm longer than the center wavelengths of reflection of the sensing FBGs $\lambda_{S1}$, $\lambda_{S2}$, . . . $\lambda_{SN}$, respectively. The narrowband optical powers at wavelengths $\lambda_{R1}$, $\lambda_{R2}$, . . . $\lambda_{RN}$ exiting port 34 are separately detected by an N-way optical-splitter-band-pass-detector-bank which has an N-way optical splitter, and N combinations of optical band-pass and optical power detectors.

In normal use, none of the center wavelengths of reflection $\lambda_{S1}$, $\lambda_{S2}$, . . . $\lambda_{SN}$ of the sensing FBGs 111, 112, . . . 11N, respectively, of the sensing fiber 5 is shifted, and hence, no optical power is detected in any of the optical power detectors 211, 212, . . . 21N. However, a stretch in a particular zone of the sensing fiber 5 is detected by optical power being detected by the corresponding optical power detector.

Advantageously, an optical spectrum analyzer may be used in lieu of the N-way optical-splitter-band-pass-detector-bank. An optical power peak displayed at wavelength $\lambda_{RX}$ detects a stretch of the sensing fiber 5 in ZONE X, where ZONE X can be any one of the zones of the sensing fiber 5.

Advantageously, any one of the zones of the sensing fiber 5 may have multiple FBGs spaced apart along the length of the zone to increase sensitivity to intrusion causing a stretch of the sensing fiber 5, which in turn allows for long zones while maintaining sensitivity to such intrusion. A sensing fiber 5 with long zones would require fewer zones, and FBGs with fewer center wavelengths of reflection. Such a sensing fiber 5 having FBGs with fewer center wavelengths of reflection is easier to manufacture. Moreover, the fewer center wavelengths of reflection can be spectrally spaced further apart for ease of detection.

Advantageously, the sensing fiber 5 is loosely looped between zones. The fiber loops 50 prevent any stretches in a zone of the sensing fiber 5 from propagating to a neighboring zone. Moreover, sufficient lengths of fiber may be looped in the fiber loops 50 to provide for fiber restoration in case of a cut of the sensing fiber 5.

Figure 5:
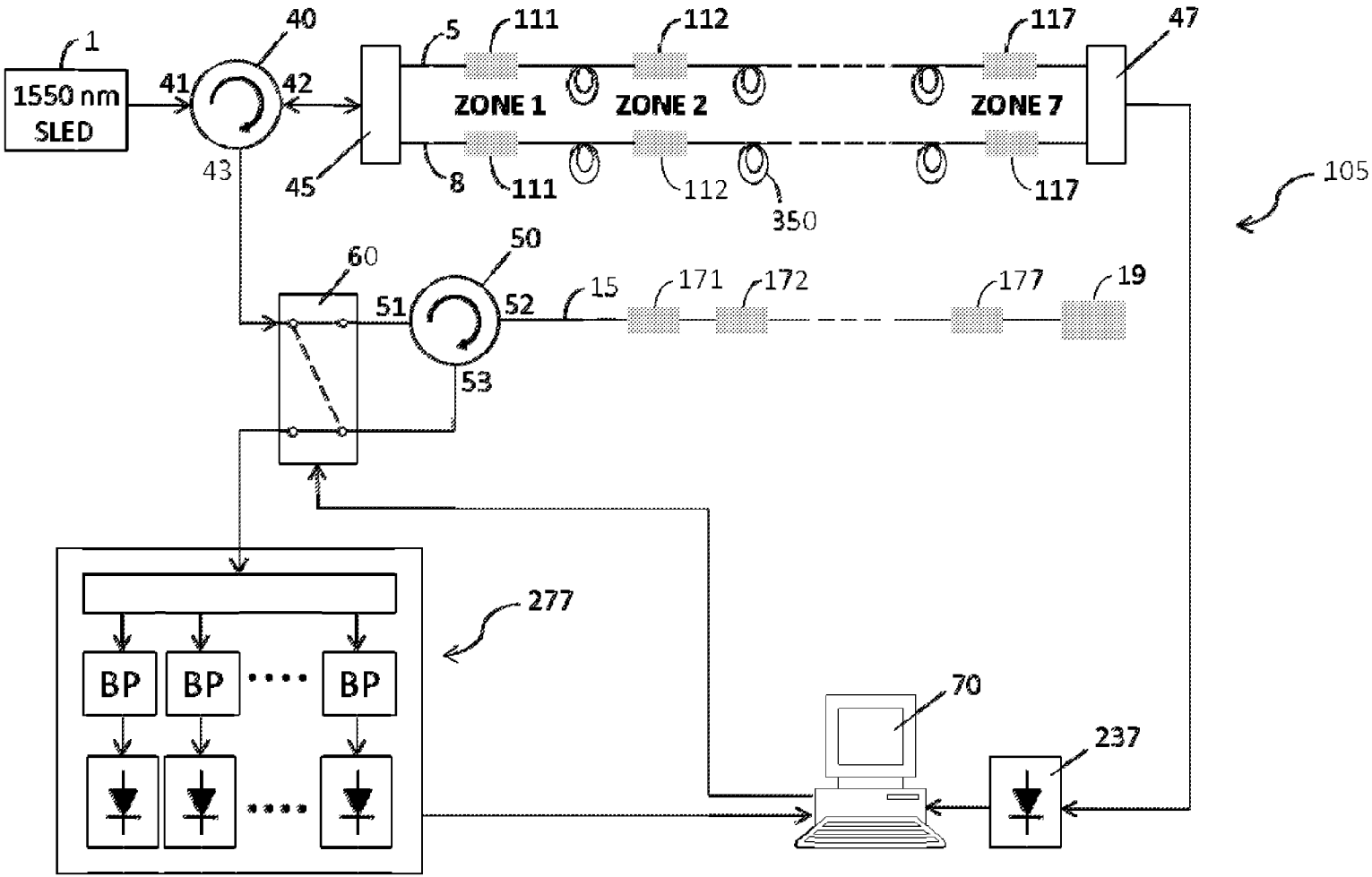
FIG. 5 shows a fifth preferred embodiment of the system having a perimeter with 7 zones, 2 sensing fibers, optical-power-detector-based means for detecting intrusion causing a cut of the sensing fiber, and a system computer.

FIG. 5 shows a fifth preferred embodiment of a Fiber Bragg Grating (FBG) perimeter security system 105. The embodiment 105 has two sensing fibers 5, 8, and 7 zones. The sensing fiber 5 may be laid out tautly along the fence fabric and the fence posts (not shown), the sensing fiber 8 may be laid out tautly along barbed wired outriggers (not shown). The proximal ends of the sensing fibers 5, 8 are fed by a broadband optical source 1, a 3-port optical circulator 40, and an optical splitter 45. The distal ends of the sensing fibers 5, 8 feed an optical splitter 47 which in turn feeds an optical power detector 237. The output of the optical power detector 237 feeds a system computer 70. Sensing FBGs 111, . . . , 117 of the sensing fibers 5, 8 reflect narrowband optical powers which travel to the optical splitter 45, port 42, port 43 of the optical circulator 40, an optical bypass switch 60, port 51, port 52 of a 3-port optical circulator 50, and a reference fiber 15 which is terminated with an optical termination 19. Reference FBGs 171, . . . , 177 of the reference fiber 15 have center wavelengths of reflection which are about 1 nm longer than the corresponding center wavelengths of reflection of the sensing FBGs 111, . . . , 117. Any optical power at any of the longer wavelengths is reflected by the reference FBGs 171, . . . , 177 back to port 52, and travel to port 53, the optical bypass switch 60, and the 7-way optical-splitter-band-pass-detector-bank 277 where the optical powers at the various wavelengths are separately detected. The output of the 7-way optical-bank 277 feeds the system computer 70. The system computer 70 controls the optical bypass switch 60 for selectively toggling the bypass switch 60 to a bypass mode, shown as a dashed line in FIG. 5, whereby the narrowband optical powers reflected by the sensing FBGs 111, . . . , 117 are routed to the 7-way optical-bank 277.

In normal use, broadband optical power with wavelengths not reflected by the sensing FBGs 111, . . . , 117 are detected by the optical power detector 237 and 'optical power detected by optical power detector 237' is communicated to the system computer 70. The center wavelengths of reflection of the sensing FBGs 111, . . . , 117 are not shifted, there are no reflections from the reference FBGs 171, . . . , 177, no optical powers are detected by the 7-way optical-bank 277, and 'no optical powers detected by the 7-way optical-bank 277' is communicated to the system computer 70.

However, if either one of the sensing fibers 5, 8 or both are stretched in an intruded zone, the shifted center wavelength of reflection of the FBG or FBGs in that zone is detected by the 7-way optical-bank 277 and the zone of intrusion is communicated to the system computer 70.

An intrusion causing a cut of either one of the sensing fibers 5, 8 or both is indicated by a significant drop of optical power or no optical power being detected by the optical power detector 237. The cut is communicated to the system computer 70 which toggles the optical bypass switch 60 to the bypass mode, shown as the dashed line in FIG. 5, whereby any narrowband optical powers from the sensing FBGs 111, . . . , 117 are detected by the 7-way optical-bank 277. A cut of either one of the sensing fibers 5, 8 or both causes at least a significant drop of narrowband optical power at the center wavelengths of reflection beyond the cut, thereby locating the zone of intrusion causing the cut.

Advantageously, the optical powers exiting the distal ends of the sensing fibers 5, 8 may be detected with separate optical power detectors for separate detection of which one of the two sensing fibers 5, 8 has been cut.

Figure 6:
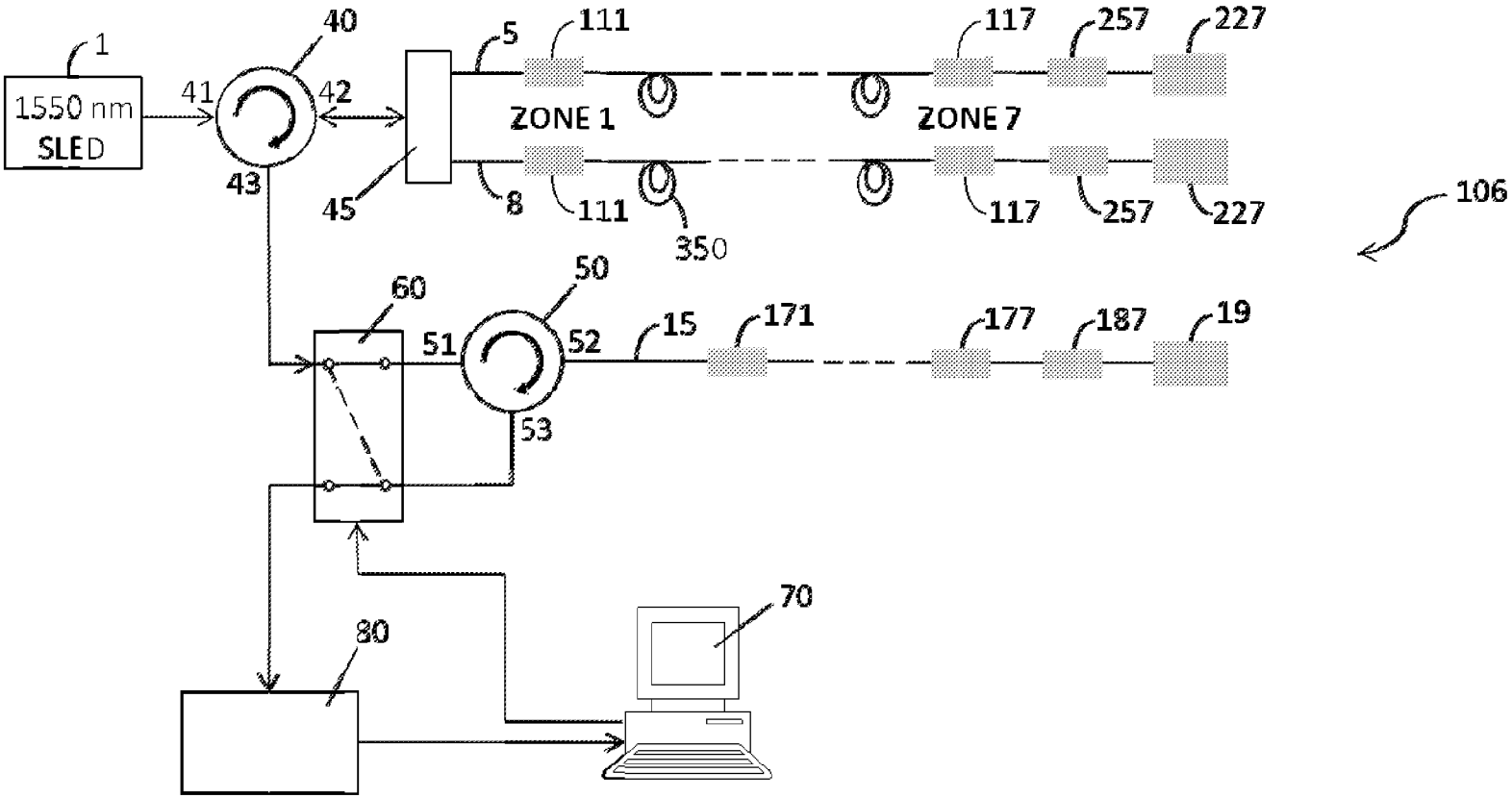
FIG. 6 shows a sixth preferred embodiment of the system having a perimeter with 7 zones, 2 sensing fibers, FBG-based means for detecting intrusion causing a cut of the sensing fiber, and a system computer.

FIG. 6 shows a sixth preferred embodiment of a Fiber Bragg Grating (FBG) perimeter security system 106 with two sensing fibers 5, 8, and 7 zones, which is similar to embodiment 105 shown in FIG. 5. However, whereas the fiber cut detection capability of embodiment 105 is based on optical power detection, the fiber cut detection capability of embodiment 106 is based on FBGs. Sensing fibers 5, 8 have fiber cut sensing FBGs 257 just before the optical terminations 227 at the distal ends of the sensing fibers 5, 8, and the reference fiber 15 has a fiber cut reference FBG 187 with a center wavelength of reflection equal to the center wavelength of reflection of the fiber cut sensing FBGs 257.

In normal use, the narrowband optical powers reflected from the fiber cut sensing FBGs 257 travel to and are reflected by the fiber cut reference FBG 187, and travel further to and are detected by an optical spectrum analyzer 80. However, a cut of either one of the sensing fibers 5, 8 or both causes at least a significant drop of the optical power detected by the optical spectrum analyzer 80. The cut is communicated to the system computer 70 which toggles the optical bypass switch 60 to route the narrowband optical powers reflected by the sensing FBGs 111, . . . , 117 to the optical spectrum analyzer 80. Any significant drops of optical power at center wavelengths of reflection of FBGs beyond the cut indicate the zone of intrusion causing the cut.

Similar to the preceding embodiments, in normal use the embodiment 106 shows no narrowband optical power being detected by the optical spectrum analyzer 80 due to the sensing FBGs 111, . . . , 117 and the reference FBGs 171, . . . , 177. However, intrusion in a zone causing a stretch of the sensing FBG or FBGs in that zone shows up at the optical spectrum analyzer 80 as optical power being present at the center wavelength of reflection of the corresponding one of the reference FBGs 171, . . . , 177, thereby locating the zone of intrusion causing the stretch.

A person skilled in the art will have by now appreciated the full scope of the invention. In particular, the scope of the invention is not limited to the preferred embodiments described by way of example in the above.

I claim:

1. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length at least one sensing Fiber Bragg Grating (FBG) having a center wavelength of reflection $\lambda_S$;

a source of broadband optical power and means for launching the broadband optical power into the proximal end of the sensing optical fiber, the sensing FBG for reflecting narrowband optical power having a center wavelength $\lambda_S$ back to the proximal end of the sensing optical fiber;

whereby stretching the sensing optical fiber and hence stretching the sensing FBG causes the center wavelength $\lambda_S$ of the reflected narrowband optical power back to the proximal end of the stretched sensing optical fiber to shift towards longer wavelengths;

at least one trip wire having one end attached to the sensing optical fiber along the length of the sensing optical fiber, the other end of the trip wire for attaching to the ground of the area to be secured; and receiving and detecting means responsive to the reflected narrowband optical power having the shifted center wavelength;

so that the perimeter security system is responsive to an intrusion into the area to be secured causing the stretch of the sensing optical fiber.

2. A perimeter security system, comprising:

a sensing optical fiber for laying out tautly at the perimeter of an area to be secured, the sensing optical fiber having a proximal end and a distal end, the sensing optical fiber having along its length at least one sensing Fiber Bragg Grating (FBG) having a center wavelength of reflection $\lambda_S$;

a source of broadband optical power and means for launching the broadband optical power into the proximal end of the sensing optical fiber, the sensing FBG for reflecting narrowband optical power having a center wavelength $\lambda_S$ back to the proximal end of the sensing optical fiber;

whereby stretching the sensing optical fiber and hence stretching the sensing FBG causes the center wavelength $\lambda_S$ of the reflected narrowband optical power back to the proximal end of the stretched sensing optical fiber to shift towards longer wavelengths;

at least one trip wire having one end attached to the sensing optical fiber along the length of the sensing optical fiber, the other end of the trip wire for attaching to the ground of the area to be secured;

receiving and detecting means responsive to the reflected narrowband optical power having the shifted center wavelength so that the perimeter security system is responsive to an intrusion into the area to be secured causing the stretch of the sensing optical fiber; and an optical power detector for detecting optical power exiting the distal end of the optical sensing fiber whereby a cut of the optical sensing fiber results in no optical power being detected by the optical power detector so that the perimeter security system is further responsive to an intrusion into the area to be secured causing the cut of the sensing optical fiber.

3. The perimeter security system according to claim 1, further comprising:

a fiber cut sensing FBG near the distal end of the sensing optical fiber just before the optical termination at the distal end of the sensing optical fiber, the fiber cut sensing FBG having a center wavelength of reflection equal to a predetermined center wavelength, the fiber cut sensing FBG for reflecting narrowband optical power having the predetermined center wavelength back to the proximal end of the sensing optical fiber;

wherein the receiving and detecting means is further responsive to the reflected narrowband optical power having the predetermined center wavelength in addition to being responsive to the reflected narrowband optical power having the shifted center wavelength;

so that the perimeter security system is further responsive to an intrusion into the area to be secured causing the cut of the sensing optical fiber in addition to being responsive to an intrusion into the area to secured causing the stretch of the sensing optical fiber.

4. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length at least one sensing Fiber Bragg Grating (FBG) having a center wavelength of reflection $\lambda_S$;

a reference optical fiber having a proximal end and a distal end, the distal end of the reference optical fiber having an optical termination for quenching reflections from the distal end of the reference optical fiber, the reference optical fiber having along its length a reference FBG having a center wavelength of reflection $\lambda_R$, wherein $\lambda_R$ is longer than $\lambda_S$;

a source of broadband optical power;

an optical power detector;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical power reflected by the sensing FBG and exiting from the proximal end of the sensing optical fiber, the optical circulator circulating the narrowband optical power reflected by the sensing FBG from the second port to the third port, the third port for launching the narrowband optical power reflected by the sensing FBG into the proximal end of the reference optical fiber;

the third port of the optical circulator further for receiving the narrowband optical power reflected by the reference FBG having the center wavelength $\lambda_R$, the optical circulator circulating the narrowband optical power having the center wavelength $\lambda_R$ from the third port to the fourth port and exiting the fourth port to impinge on the optical power detector;

whereby stretching the sensing optical fiber and hence stretching the sensing FBG causes the center wavelength $\lambda_S$ of the reflected narrowband optical power back to the proximal end of the stretched sensing optical fiber to shift towards the longer wavelength $\lambda_R$ to impinge on the optical power detector;

so that the perimeter security system is responsive to an intrusion into the area to be secured causing the stretch of the sensing optical fiber.

5. A perimeter security system, comprising:

a sensing optical fiber for laying out tautly at the perimeter of an area to be secured, the sensing optical fiber having a proximal end and a distal end, the sensing optical fiber having along its length at least one sensing Fiber Bragg Grating (FBG) having a center wavelength of reflection $\lambda_S$;

a reference optical fiber having a proximal end and a distal end, the distal end of the reference optical fiber having an optical termination for quenching reflections from the distal end of the reference optical fiber, the reference optical fiber having along its length a reference FBG having a center wavelength of reflection $\lambda_R$, wherein $\lambda_R$ is longer than $\lambda_S$;

a source of broadband optical power;

first optical power detector;

a second optical power detector;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical power reflected by the sensing FBG and exiting from the proximal end of the sensing optical fiber, the optical circulator circulating the narrowband optical power reflected by the sensing FBG from the second port to the third port, the third port for launching the narrowband optical power reflected by the sensing FBG into the proximal end of the reference optical fiber;

the third port of the optical circulator further for receiving narrowband optical power reflected by the reference FBG having the center wavelength $\lambda_R$, the optical circulator circulating the narrowband optical power reflected by the reference FBG having the center wavelength $\lambda_R$ from the third port to the fourth port and exiting the fourth port to impinge on the second optical power detector;

whereby stretching the sensing optical fiber and hence stretching the sensing FBG causes the center wavelength $\lambda_S$ of the reflected narrowband optical power back to the proximal end of the stretched sensing optical fiber to shift towards the longer wavelength $\lambda_R$ to impinge on the second optical power detector;

the first optical power detector for detecting optical power exiting the distal end of the optical sensing fiber whereby a cut of the optical sensing fiber results in no optical power being detected by the first optical power detector;

so that the perimeter security system is responsive to an intrusion into the area to be secured causing the cut of the sensing optical fiber and responsive to an intrusion into the area to be secured causing a stretch of the sensing optical fiber.

6. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length at least one sensing Fiber Bragg Grating (FBG) having a center wavelength of reflection $\lambda_S$;

a first fiber cut sensing FBG near the distal end of the sensing optical fiber just before the optical termination at the distal end of the sensing optical fiber, the fiber cut sensing FBG having a center wavelength of reflection equal to a predetermined center wavelength, the fiber cut sensing FBG for reflecting narrowband optical power having the predetermined center wavelength back to the proximal end of the sensing optical fiber;

a reference optical fiber having a proximal end and a distal end, the distal end of the reference optical fiber having an optical termination for quenching reflections from the distal end of the reference optical fiber, the reference optical fiber having along its length a reference FBG having a center wavelength of reflection $\lambda_R$, wherein $\lambda_R$ is longer than $\lambda_S$, the reference optical fiber further having along its length a second fiber cut reference FBG having a center wavelength of reflection equal to the predetermined center wavelength;

a source of broadband optical power;

an optical power detector for separately detecting the power level of the narrowband optical power having the center wavelength $\lambda_R$ and the power level of the narrowband optical power having the predetermined center wavelength;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical power reflected by the sensing FBG along the length of the sensing optical fiber and the narrowband optical power reflected by the first fiber cut sensing FBG near the distal end of the sensing optical fiber, the optical circulator circulating the narrowband optical powers reflected by the sensing FBG along the length of the sensing optical fiber and the first fiber cut sensing FBG near the distal end of the reference optical fiber from the second port to the third port, the third port for launching the narrowband optical powers reflected by the sensing FBG and the first fiber cut sensing FBG into the proximal end of the reference optical fiber;

the third port of the optical circulator further for receiving the narrowband optical power reflected by the reference FBG along the length of the reference optical fiber and the narrowband optical power reflected by the second fiber cut reference FBG along the length of the reference optical fiber, the optical circulator circulating the narrowband optical powers reflected by the reference FGB and the second fiber cut reference FBG from the third port to the fourth port and exiting the fourth port to impinge on the optical power detector;

whereby stretching the sensing optical fiber and hence stretching the sensing FBG causes the center wavelength $\lambda_S$ of the reflected narrowband optical power back to the proximal end of the stretched sensing optical fiber to shift towards the longer wavelength $\lambda_R$ to impinge on the optical power detector; and whereby a cut of the sensing optical fiber causes no optical power at the predetermined center wavelength to impinge on the optical power detector;

so that the perimeter security system is responsive to an intrusion into the area to be secured causing the stretch of the sensing optical fiber and responsive to an intrusion into the area to be secured causing the cut of the sensing optical fiber.

7. The perimeter security system according to claim 6, wherein the optical power detector for detecting optical power exiting the fourth port of the optical circulator comprises:

an optical splitter, first and second band-pass filters, and first and second power detectors;

the optical splitter for receiving the optical power exiting the fourth port of the optical circulator and feeding the first and second band-pass filters;

the first and second band-pass filters for passing narrowband optical powers having center wavelengths at $\lambda_R$ and the predetermined center wavelength, respectively, to the first and second optical power detectors, respectively.

8. The perimeter security system according to claim 6, wherein the optical power detector for detecting optical power exiting the fourth port of the optical circulator comprises a spectrum analyzer.

9. The perimeter security system according to any one of claims 1 to 8, wherein the source of broadband optical power comprises one of a Surface-emitting Light-Emitting-Diode and an Amplified Spontaneous Emission device emitting broadband optical power in the 1550 nm region.

10. The perimeter security system according to any one of claims 4 to 8, wherein $\lambda_R$ is about 1 nm longer than $\lambda_S$.

11. The perimeter security system according to any one of claims 1 to 8, wherein the sensing optical fiber has a loose buffer coating.

12. The perimeter security system according to claim 11, wherein the loose buffer coating is weather-proof.

13. The perimeter security system according to any one of claims 4 to 8, further comprising at least one trip wire having one end attached to the sensing optical fiber along the length of the sensing optical fiber, the other end of the trip wire for attaching to the ground of the area to be secured.

14. The perimeter security system according to any one of claims 1 to 8, comprising a plurality of sensing FBGs spaced apart along the length of the optical sensing fiber, the sensing FBGs having the same center wavelength of reflection $\lambda_S$.

15. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length $N \geqq 2$ zones, each zone having at least one sensing Fiber Bragg Grating (FBG), the sensing FBGs of the N zones having center wavelengths of reflection $\lambda_{S1}$, $\lambda_{S2}$, . . . $\lambda_{SN}$, respectively;

a source of broadband optical power and means for launching the broadband optical power into the proximal end of the sensing optical fiber, the sensing FBGs of the N zones reflecting narrowband optical powers having the center wavelengths $\lambda_{S1}$, $\lambda_{S2}$, . . . $\lambda_{SN}$, respectively, back to the proximal end of the sensing optical fiber;

whereby stretching the sensing optical fiber in a particular zone and hence stretching the sensing FBG in the particular zone causes the corresponding center wavelength of the reflected narrowband optical power back to the proximal end of the stretched sensing optical fiber to shift towards longer wavelengths;

at least one trip wire having one end attached to the sensing optical fiber along the length of the sensing optical fiber, the other end of the trip wire for attaching to the ground of the area to be secured; and receiving and detecting means responsive to the reflected narrowband optical powers having the shifted center wavelengths so that the perimeter security system is responsive to an intrusion into the area to be secured via the particular zone causing the stretch of the sensing optical fiber in the particular zone.

16. A perimeter security system, comprising:

a sensing optical fiber for laying out tautly at the perimeter of an area to be secured, the sensing optical fiber having a proximal end and a distal end, the sensing optical fiber having along its length $N \geqq 2$ zones, each zone having at least one sensing Fiber Bragg Grating (FBG), the sensing FBGs of the N zones having center wavelengths of reflection $\lambda_{S1}$, $\lambda_{S2}$, . . . $\lambda_{SN}$, respectively;

a source of broadband optical power and means for launching the broadband optical power into the proximal end of the sensing optical fiber, the sensing FBGs of the N zones reflecting narrowband optical powers having the center wavelengths $\lambda_{S1}$, $\lambda_{S2}$, . . . $\lambda_{SN}$, respectively, back to the proximal end of the sensing optical fiber;

whereby stretching the sensing optical fiber in a particular zone and hence stretching the sensing FBG in the particular zone causes the corresponding center wavelength of the reflected narrowband optical power back to the proximal end of the stretched sensing optical fiber to shift towards longer wavelengths;

at least one trip wire having one end attached to the sensing optical fiber along the length of the sensing optical fiber, the other end of the trip wire for attaching to the ground of the area to be secured;

receiving and detecting means responsive to the reflected narrowband optical powers having the shifted center wavelengths so that the perimeter security system is responsive to an intrusion into the area to be secured via the particular zone causing the stretch of the sensing optical fiber in the particular zone; and an optical power detector for detecting optical power exiting the distal end of the optical sensing fiber whereby a cut of the optical sensing fiber results in no optical power being detected by the optical power detector so that the perimeter security system is further responsive to an intrusion into the area to be secured causing the cut of the sensing optical fiber.

17. The perimeter security system according to claim 15, further comprising:

a fiber cut sensing FBG near the distal end of the sensing optical fiber just before the optical termination at the distal end of the sensing optical fiber, the fiber cut sensing FBG having a center wavelength of reflection equal to a predetermined center wavelength, the fiber cut sensing FBG for reflecting narrowband optical power having the predetermined center wavelength back to the proximal end of the sensing optical fiber;

wherein the receiving and detecting means is further responsive to the reflected narrowband optical power having the predetermined center wavelength in addition to being responsive to the reflected narrowband optical powers having the shifted center wavelengths;

so that the perimeter security system is further responsive to an intrusion into the area to be secured causing the cut of the sensing optical fiber in addition to being responsive to an intrusion into the area to secured via the particular zone causing the stretch of the sensing optical fiber in the particular zone.

18. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length $N \geqq 2$ zones, each zone having at least one sensing Fiber Bragg Grating (FBG), the sensing FBGs of the N zones having center wavelengths of reflection $\lambda_{S1}$, $\lambda_{S2}, \ldots \lambda_{SN}$, respectively;

a reference optical fiber having a proximal end and a distal end, the distal end of the reference optical fiber having an optical termination for quenching reflections from the distal end of the reference optical fiber, the reference optical fiber having along its length N reference FBGs having center wavelengths of reflection $\lambda_{R1}$, $\lambda_{R2}, \ldots \lambda_{RN}$, respectively, wherein each center wavelength of reflection of the reference FBGs $\lambda_{R1}$, $\lambda_{R2}, \ldots \lambda_{RN}$, respectively, is longer than the corresponding center wavelength of reflection of the sensing FBGs in the N zones $\lambda_{S1}$, $\lambda_{S2}, \ldots \lambda_{SN}$, respectively;

a source of broadband optical power;

an optical power detector;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical powers reflected by the sensing FBGs having the center wavelengths $\lambda_{S1}$, $\lambda_{S2}, \ldots \lambda_{SN}$, respectively, and exiting from the proximal end of the sensing optical fiber, the optical circulator circulating the narrowband optical powers reflected by the sensing FBGs having the center wavelengths $\lambda_{S1}$, $\lambda_{S2}, \ldots \lambda_{SN}$, respectively, from the second port to the third port, the third port for launching the narrowband optical powers reflected by the sensing FBGs having the center wavelengths $\lambda_{S1}$, $\lambda_{S2}, \ldots \lambda_{SN}$, respectively, into the proximal end of the reference optical fiber;

the third port of the optical circulator further for receiving the narrowband optical powers reflected by the reference FBGs having the center wavelengths $\lambda_{R1}$, $\lambda_{R2}, \ldots \lambda_{RN}$, respectively, the optical circulator circulating the narrowband optical powers reflected by the reference FBGs having the center wavelengths $\lambda_{R1}$, $\lambda_{R2}, \ldots \lambda_{RN}$, respectively, from the third port to the fourth port and exiting the fourth port to impinge on the optical power detector;

the optical power detector for separately detecting the power levels of the narrowband optical powers having the center wavelengths $\lambda_{R1}$, $\lambda_{R2}, \ldots \lambda_{RN}$, respectively;

whereby stretching the sensing optical fiber in a particular zone and hence stretching the sensing FBG in the particular zone causes the corresponding center wavelength of the reflected narrowband optical power back to the proximal end of the stretched sensing optical fiber to shift towards the corresponding longer wavelength detectable by the optical power detector;

so that the perimeter security system is responsive to an intrusion into the area to be secured via the particular zone causing the stretch of the sensing optical fiber in the particular zone.

19. A perimeter security system, comprising:

a sensing optical fiber for laying out tautly at the perimeter of an area to be secured, the sensing optical fiber having a proximal end and a distal end, the sensing optical fiber having along its length $N \geqq 2$ zones, each zone having at least one sensing Fiber Bragg Grating (FBG), the sensing FBGs of the N zones having center wavelengths of reflection $\lambda_{S1}$, $\lambda_{S2}, \ldots \lambda_{SN}$, respectively;

a reference optical fiber having a proximal end and a distal end, the distal end of the reference optical fiber having an optical termination for quenching reflections from the distal end of the reference optical fiber, the reference optical fiber having along its length N reference FBGs having center wavelengths of reflection $\lambda_{R1}$, $\lambda_{R2}, \ldots \lambda_{RN}$, respectively, wherein each center wavelength of reflection of the reference FBGs $\lambda_{R1}$, $\lambda_{R2}, \ldots \lambda_{RN}$, respectively, is longer than the corresponding center wavelength of reflection of the sensing FBGs in the N zones $\lambda_{S1}$, $\lambda_{S2}, \ldots \lambda_{SN}$, respectively;

a source of broadband optical power;

a first optical power detector;

a second optical power detector;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical powers reflected by the sensing FBGs having the wavelengths $\lambda_{S1}, \lambda_{S2}, \ldots \lambda_{SN}$, respectively, and exiting from the proximal end of the sensing optical fiber, the optical circulator circulating the narrowband optical powers reflected by the sensing FBGs having the wavelengths $\lambda_{S1}, \lambda_{S2}, \ldots \lambda_{SN}$, respectively, from the second port to the third port, the third port for launching the narrowband optical powers reflected by the sensing FBGs having the wavelengths $\lambda_{S1}, \lambda_{S2}, \ldots \lambda_{SN}$, respectively, into the proximal end of the reference optical fiber;

the third port of the optical circulator further for receiving the narrowband optical powers reflected by the reference FBGs having the center wavelengths $\lambda_{R1}, \lambda_{R2}, \ldots \lambda_{RN}$, respectively, the optical circulator circulating the narrowband optical powers reflected by the reference FBGs having the center wavelengths $\lambda_{R1}, \lambda_{R2}, \ldots \lambda_{RN}$, respectively, from the third port to the fourth port and exiting the fourth port to impinge on the second optical detector;

the second optical power detector for separately detecting the power levels of the narrowband optical powers having the center wavelengths $\lambda_{R1}, \lambda_{R2}, \ldots \lambda_{RN}$, respectively;

whereby stretching the sensing optical fiber in a particular zone and hence stretching the sensing FBG in the particular zone causes the corresponding center wavelength of the reflected narrowband optical power back to the proximal end of the stretched sensing optical fiber to shift towards the corresponding longer wavelength detectable by the second optical power detector;

the first optical power detector for detecting optical power exiting the distal end of the optical sensing fiber whereby a cut of the optical sensing fiber results in no optical power being detected by the first optical power detector;

so that the perimeter security system is responsive to an intrusion into the area to be secured causing the cut of the sensing optical fiber and responsive to an intrusion into the area to be secured via the particular zone causing the stretch of the sensing fiber in the particular zone.

20. A perimeter security system, comprising:

a sensing optical fiber for laying out tautly at the perimeter of an area to be secured, the sensing optical fiber having a proximal end and a distal end, the distal end of the sensing optical fiber having an optical termination for quenching reflections from the distal end of the sensing optical fiber, the sensing optical fiber having along its length $N \geqq 2$ zones, each zone having at least one sensing Fiber Bragg Grating (FBG), the sensing FBGs of the N zones having center wavelengths of reflection $\lambda_{S1}, \lambda_{S2}, \ldots \lambda_{SN}$, respectively;

a fiber cut sensing FBG near the distal end of the sensing optical fiber just before the optical termination at the distal end of the sensing optical fiber, the fiber cut sensing FBG having a center wavelength of reflection equal to a predetermined center wavelength, the fiber cut sensing FBG for reflecting narrowband optical power having the predetermined center wavelength back to the proximal end of the sensing optical fiber;

a reference optical fiber having a proximal end and a distal end, the distal end of the reference optical fiber having an optical termination for quenching reflections from the distal end of the reference optical fiber, the reference optical fiber having along its length N reference FBGs having center wavelengths of reflection $\lambda_{R1}, \lambda_{R2}, \ldots \lambda_{RN}$, respectively, wherein each center wavelength of reflection of the reference FBGs $\lambda_{R1}, \lambda_{R2}, \ldots \lambda_{RN}$, respectively, is longer than the corresponding center wavelength of reflection of the sensing FBGs in the N zones $\lambda_{S1}, \lambda_{S2}, \ldots \lambda_{SN}$, respectively, the reference optical fiber further having along its length a fiber cut reference FBG having a center wavelength of reflection equal to the predetermined center wavelength;

a source of broadband optical power;

an optical power detector;

an optical circulator having a first port, a second port, a third port, and a fourth port;

the first port of the optical circulator for receiving the broadband optical power from the source of broadband optical power, the optical circulator circulating the broadband optical power from the first port to the second port, the second port for launching the broadband optical power into the proximal end of the sensing optical fiber;

the second port of the optical circulator further for receiving the narrowband optical powers reflected by the sensing FBGs along the length of the sensing optical fiber having the wavelengths $\lambda_{S1}, \lambda_{S2}, \ldots \lambda_{SN}$, respectively, and the narrowband optical power reflected by the fiber cut sensing FBG near the distal end of the sensing optical fiber having the predetermined wavelength, the optical circulator circulating the narrowband optical powers reflected by the sensing FBGs along the length of the sensing optical fiber having the wavelengths $\lambda_{S1}, \lambda_{S2}, \ldots \lambda_{SN}$, respectively, and the fiber cut sensing FBG near the distal end of the sensing optical fiber having the predetermined wavelength, from the second port to the third port, the third port for launching the narrowband optical powers reflected by the sensing FBGs along the length of the sensing optical fiber having the wavelengths $\lambda_{S1}, \lambda_{S2}, \ldots \lambda_{SN}$, respectively, and the fiber cut sensing FBG near the distal end of the sensing optical fiber having the predetermined wavelength, into the proximal end of the reference optical fiber;

the third port of the optical circulator further for receiving the narrowband optical powers reflected by the reference FBGs along the length of the reference optical fiber having the wavelengths $\lambda_{R1}, \lambda_{R2}, \ldots \lambda_{RN}$, respectively, and the narrowband optical power reflected by the fiber cut reference FBG along the length of the reference optical fiber having the predetermined wavelength, the optical circulator circulating the narrowband optical powers reflected by the reference FBGs along the length of the reference optical fiber having the wavelengths $\lambda_{R1}, \lambda_{R2}, \ldots \lambda_{RN}$, respectively, and the fiber cut reference FBG along the length of the reference optical fiber having the predetermined wavelength, from the third port to the fourth port and exiting the fourth port to impinge on the optical power detector;

the optical power detector for separately detecting the power levels of the narrowband optical powers having the predetermined center wavelength and the center wavelengths $\lambda_{R1}, \lambda_{R2}, \ldots \lambda_{RN}$, respectively;

whereby a cut of the sensing optical fiber causes no optical power at the predetermined center wavelength to impinge on the optical power detector; and whereby stretching the sensing optical fiber in a particular zone and hence stretching the sensing FBG in the particular zone causes the corresponding center wavelength of the reflected narrowband optical power back to the proximal end of the stretched sensing optical fiber to shift towards the longer wavelength detectable by the optical power detector;

so that the perimeter security system is responsive to an intrusion into the area to be secured causing the cut of the sensing optical fiber and responsive to an intrusion into the area to be secured via the particular zone causing the stretch of the sensing optical fiber in the particular zone.

21. The perimeter security system according to claim 18, wherein the optical power detector comprises:

an optical splitter, a bank of N band-pass filters, and a bank of N detectors;

the optical splitter for receiving the optical power exiting the fourth port of the optical circulator and feeding the N band-pass filters;

the N band-pass filters for passing narrowband optical powers having the center wavelengths $\lambda_{R1}, \lambda_{R2}, \ldots \lambda_{RN}$, respectively, to the N optical power detectors, respectively.

22. The perimeter security system according to claim 18, wherein the optical power detector comprises a spectrum analyzer.

23. The perimeter security system according to claim 19, wherein the second optical power detector comprises:

an optical splitter, a bank of N band-pass filters, and a bank of N detectors;

the optical splitter for receiving the optical power exiting the fourth port of the optical circulator and feeding the N band-pass filters;

the N band-pass filters for passing narrowband optical powers having the center wavelengths $\lambda_{R1}, \lambda_{R2}, \ldots \lambda_{RN}$, respectively, to the N optical power detectors, respectively.

24. The perimeter security system according to claim 19, wherein the second optical power detector comprises a spectrum analyzer.

25. The perimeter security system according to claim 20, wherein the optical power detector comprises:

an optical splitter, a bank of N+1 band-pass filters, and a bank of N+1 detectors;

the optical splitter for receiving the optical power exiting the fourth port of the optical circulator and feeding the N+1 band-pass filters;

the N+1 band-pass filters for passing narrowband optical powers having the center wavelengths $\lambda_{R1}, \lambda_{R2}, \ldots \lambda_{RN}$ and the predetermined center wavelength, respectively, to the N+1 optical power detectors, respectively.

26. The perimeter security system according to claim 20, wherein the optical power detector comprises a spectrum analyzer.

27. The perimeter security system according to any one of claims 15 to 26, wherein the source of broadband optical power comprises one of a Surface-emitting Light-Emitting-Diode and an Amplified Spontaneous Emitting device emitting broadband optical power in the 1550 nm region.

28. The perimeter security system according to any one of claims 18 to 26, wherein each center wavelength of reflection of the reference FBGs $\lambda_{R1}, \lambda_{R2}, \ldots \lambda_{RN}$, respectively, is about 1 nm longer than the corresponding center wavelength of reflection of the sensing FBGs in the N zones $\lambda_{S1}, \lambda_{S2}, \ldots \lambda_{SN}$, respectively.

29. The perimeter security system according to any one of claims 15 to 26, wherein the sensing optical fiber has a loose buffer coating.

30. The perimeter security system according to claim 29, wherein the loose buffer coating is weather-proof.

31. The perimeter security system according to any one of claims 18 to 26, further comprising at least one trip wire having one end attached to the sensing optical fiber along the length of the sensing optical fiber, the other end of the trip wire for attaching to the ground of the area to be secured.

32. The perimeter security system according to any one of claims 15 to 26, comprising a plurality of sensing FBGs spaced apart along the length of at least one zone of the sensing optical fiber, the sensing FBGs within the zone having the same center wavelength of reflection.

33. A perimeter security system, comprising:

$M \geqq 2$ sensing optical fibers for laying out tautly at the perimeter of an area to be secured, each sensing optical fiber having a proximal end and a distal end, each sensing optical fiber having along its length $N \geqq 2$ zones, each zone having at least one sensing Fiber Bragg Grating (FBG), the sensing FBGs of the N zones having center wavelengths of reflection $\lambda_{S1}, \lambda_{S2}, \ldots \lambda_{SN}$, respectively;

a reference optical fiber having a proximal end and a distal end, the distal end of the reference optical fiber having an optical termination for quenching reflections from the distal end of the reference optical fiber, the reference optical fiber having along its length N reference FBGs having center wavelengths of reflection $\lambda_{R1}, \lambda_{R2}, \ldots \lambda_{RN}$, respectively, wherein each center wavelength of reflection of the reference FBGs $\lambda_{R1}, \lambda_{R2}, \ldots \lambda_{RN}$, respectively, is longer than the corresponding center wavelength of reflection of the sensing FBGs in the N zones $\lambda_{S1}, \lambda_{S2}, \ldots \lambda_{SN}$, respectively;

a source of broadband optical power;

a first optical splitter;

a first optical power detector;

a first optical circulator having a first port, a second port, and a third port, and a second optical circulator having a first port, a second port, and a third port;

the first port of the first optical circulator for receiving the broadband optical power from the source of broadband optical power, the first optical circulator circulating the broadband optical power from the first port of the first optical circulator to the second port of the first optical circulator, the second port of the first optical circulator for feeding the first optical splitter, the first optical splitter for splitting and launching the broadband optical power into the proximal ends of the sensing optical fibers;

the first optical splitter further for receiving and combining the narrowband optical powers reflected by the sensing FBGs having the center wavelengths $\lambda_{S1}, \lambda_{S2}, \ldots \lambda_{SN}$, respectively, and exiting from the proximal ends of the sensing optical fibers, the second port of the first optical circulator further for receiving the combined narrowband optical powers reflected by the sensing FBGs having the center wavelengths $\lambda_{S1}, \lambda_{S2}, \ldots \lambda_{SN}$, respectively, the first optical circulator circulating the combined narrowband optical powers reflected by the sensing FBGs having the center wavelengths $\lambda_{S1}, \lambda_{S2}, \ldots \lambda_{SN}$, respectively, from the second port of the first optical circulator to the third port of the first optical circulator, the third port of the first optical circulator for feeding the combined narrowband optical powers reflected by the sensing FBGs having the center wavelengths $\lambda_{S1}, \lambda_{S2}, \ldots \lambda_{SN}$, respectively, into the first port of the second optical circulator, the second optical circulator circulating the combined narrowband optical powers reflected by the sensing FBGs having the center wavelengths $\lambda_{S1}, \lambda_{S2}, \ldots \lambda_{SN}$, respectively, from the first port of the second optical circulator to the second port of the second optical circulator, the second port of the second optical circulator for launching the combined narrowband optical powers reflected by the sensing FBGs having the center wavelengths $\lambda_{S1}, \lambda_{S2}, \ldots \lambda_{SN}$, respectively, into the proximal end of the reference optical fiber;

the second port of the second optical circulator further for receiving the narrowband optical powers reflected by the reference FBGs having the center wavelengths $\lambda_{R1}$, $\lambda_{R2}$, . . . $\lambda_{RN}$, respectively, the second optical circulator circulating the narrowband optical powers reflected by the reference FBGs having the center wavelengths $\lambda_{R1}$, $\lambda_{R2}$, . . . $\lambda_{RN}$, respectively, from the second port of the second optical circulator to the third port of the second optical circulator and exiting the third port of the second optical circulator to impinge on the first optical power detector;

the first optical power detector for separately detecting power levels of narrowband optical powers having center wavelengths $\lambda_{R1}$, $\lambda_{R2}$, . . . $\lambda_{RN}$, respectively;

whereby stretching at least one of the sensing optical fibers in a particular zone and hence stretching the sensing FBG of the stretched sensing optical fiber in the particular zone causes the corresponding center wavelength of the reflected narrowband optical power back to the proximal end of the stretched sensing optical fiber to shift towards the longer wavelength detectable by the first optical power detector;

optical power detector means for detecting optical powers exiting the distal ends of the sensing optical fibers whereby a cut of a sensing optical fiber results in no power exiting from the cut sensing optical fiber;

so that the perimeter security system is responsive to an intrusion into the area to be secured causing the cut of at least one of the sensing optical fibers and responsive to an intrusion into the area to be secured via the particular zone causing the stretch of at least one of the sensing optical fiber in the particular zone.

34. The perimeter security system according to claim 33, wherein the first optical power detector for detecting optical power exiting the third port of the second optical circulator comprises:

an optical splitter for receiving the optical power exiting the third port of the second optical circulator;

a bank of N optical band-passes having center wavelengths $\lambda_{R1}$, $\lambda_{R2}$, . . . $\lambda_{RN}$, respectively;

a bank of N optical power detectors;

wherein the optical splitter feeds the N optical band-passes, and each optical band-pass feeds a corresponding optical power detector of the bank of N optical power detectors.

35. The perimeter security system according to claim 33, wherein the optical power detector for detecting optical power exiting the third port of the second optical circulator comprises an optical spectrum analyzer.

36. The perimeter security system according to any one of claims 33 to 35, wherein the optical power detector means for detecting optical powers exiting the distal ends of the sensing optical fibers comprises a second optical splitter for combining the optical powers exiting the distal ends of the sensing optical fibers and feeding the combined optical powers to a second optical power detector.

37. A perimeter security system comprising:

M≧2 sensing optical fibers for laying out tautly at the perimeter of an area to be secured, each sensing optical fiber having a proximal end and a distal end, the distal end of each sensing optical fiber having an optical termination for quenching reflections from the distal end of the sensing optical fiber, each sensing optical fiber having a fiber cut sensing FBG near the distal end of the sensing optical fiber just before the optical termination at the distal end of the sensing optical fiber, the fiber cut sensing FBGs having a center wavelength of reflection equal to a predetermined center wavelength, each sensing optical fiber having along its length N≧2 zones, each zone having at least one sensing Fiber Bragg Grating (FBG), the sensing FBGs of the N zones having center wavelengths of reflection $\lambda_{S1}$, $\lambda_{S2}$, . . . $\lambda_{SN}$, respectively;

a reference optical fiber having a proximal end and a distal end, the distal end of the reference optical fiber having an optical termination for quenching reflections from the distal end of the reference optical fiber, the reference optical fiber having along its length a fiber cut reference FBG having a center wavelength of reflection equal to the predetermined center wavelength and N reference FBGs having center wavelengths of reflection $\lambda_{R1}$, $\lambda_{R2}$, . . . $\lambda_{RN}$, respectively, wherein each center wavelength of reflection of the reference FBGs $\lambda_{R1}$, $\lambda_{R2}$, . . . $\lambda_{RN}$, respectively, is longer than the corresponding center wavelength of reflection of the sensing FBGs in the N zones $\lambda_{S1}$, $\lambda_{S2}$, . . . $\lambda_{SN}$, respectively;

a source of broadband optical power;

an optical splitter;

an optical power detector;

a first optical circulator having a first port, a second port, and a third port, and a second optical circulator having a first port, a second port, and a third port;

the first port of the first optical circulator for receiving the broadband optical power from the source of broadband optical power, the first optical circulator circulating the broadband optical power from the first port of the first optical circulator to the second port of the first optical circulator, the second port of the first optical circulator for feeding the optical splitter, the optical splitter for splitting and launching the broadband optical power into the proximal ends of the sensing optical fibers;

the optical splitter further for receiving and combining the narrowband optical powers reflected by the sensing FBGs and exiting from the proximal ends of the sensing optical fibers, the second port of the first optical circulator further for receiving the combined narrowband optical powers reflected by the sensing FBGs, the first optical circulator circulating the combined narrowband optical powers reflected by the sensing FBGs from the second port of the first optical circulator to the third port of the first optical circulator, the third port of the first optical circulator for feeding the combined narrowband optical powers reflected by the sensing FBGs into the first port of the second optical circulator, the second optical circulator circulating the combined narrowband optical powers reflected by the sensing FBGs from the first port of the second optical circulator to the second port of the second optical circulator, the second port of the second optical circulator for launching the combined narrowband optical powers reflected by the sensing FBGs into the proximal end of the reference optical fiber;

the second port of the second optical circulator further for receiving the narrowband optical powers reflected by the fiber cut reference FBG having the center wavelength of reflection equal to the predetermined center wavelength and by the reference FBGs having the center wavelengths $\lambda_{R1}$, $\lambda_{R2}$, . . . $\lambda_{RN}$, respectively, the second optical circulator circulating the narrowband optical powers having the center wavelengths $\lambda_{R1}$, $\lambda_{R2}$, . . . $\lambda_{RN}$, and the predetermined center wavelength, respectively, from the second port of the second optical circulator to the third port of the second optical circulator and exiting the third port of the second optical circulator to impinge on the optical power detector;

the optical power detector for separately detecting power levels of narrowband optical powers having center wavelengths $\lambda_{R1}, \lambda_{R2}, \ldots \lambda_{RN}$, and the predetermined center wavelength, respectively;

whereby stretching at least one of the sensing optical fibers in a particular zone and hence stretching the sensing FBG in the stretched sensing optical fiber in the particular zone causes the corresponding center wavelength of the reflected narrowband optical power back to the proximal end of the stretched sensing optical fiber to shift towards the longer wavelengths detectable by the optical power detector; and whereby a cut of at least one of the sensing optical fibers causes no optical power at the predetermined wavelength to be reflected from the cut sensing optical fiber detectable by the optical power detector;

so that the perimeter security system is responsive to an intrusion into the area to be secured via the particular zone causing the stretch of the sensing optical fiber in the particular zone and responsive to an intrusion into the area to be secured causing the cut of at least one of the sensing optical fibers.

38. The perimeter security system according to claim 37, wherein the optical power detector for detecting optical power exiting the third port of the second optical circulator comprises:

an optical splitter for receiving the optical power exiting the third port of the second optical circulator;

a bank of N+1 optical band-passes having center wavelengths $\lambda_{R1}, \lambda_{R2}, \ldots \lambda_{RN}$, and the predetermined center wavelength, respectively;

a bank of N+1 optical power detectors;

wherein the optical splitter feeds the N+1 optical band-passes, and each optical band-pass feeds a corresponding optical power detector of the bank of N+1 optical power detectors.

39. The perimeter security system according to claim 37, wherein the optical power detector for detecting optical power exiting the third port of the second optical circulator comprises a spectrum analyzer.

40. The perimeter security system according to any one of claims 33 to 35 and claims 37 to 39, wherein the source of broadband optical power comprises one of a Surface-emitting Light-Emitting-Diode and an Amplified Spontaneous Emitting device emitting broadband optical power in the 1550 nm region.

41. The perimeter security system according to any one of claims 33 to 35 and claims 37 to 39, wherein each center wavelength of reflection of the reference FBGs $\lambda_{R1}, \lambda_{R2}, \ldots \lambda_{RN}$, respectively, is about 1 nm longer than the corresponding center wavelength of reflection of the sensing FBGs $\lambda_{S1}, \lambda_{S2}, \ldots \lambda_{SN}$, respectively.

42. The perimeter security system according to any one of claims 33 to 35 or claims 37 to 39, wherein the sensing optical fiber has a loose buffer coating.

43. The perimeter security system according to claim 42, wherein the loose buffer coating is weather-proof.

44. The perimeter security system according to any one of claims 33 to 35 and claims 37 to 39, comprising a plurality of sensing FBGs spaced apart along the length of at least one zone of the optical sensing fiber, the sensing FBGs within the zone having the same center wavelength of reflection.

* * * * *